US011572983B1

(12) United States Patent
Jackson

(10) Patent No.: US 11,572,983 B1
(45) Date of Patent: Feb. 7, 2023

(54) ILLUMINATED CONTAINER

(71) Applicant: Peacock Law P.C., Albuquerque, NM (US)

(72) Inventor: Kevin R. Jackson, Albuquerque, NM (US)

(73) Assignee: Peacock Law P.C., Albuquerque, NM (US)

( * ) Notice: Subject to any disclaimer, the term of this patent is extended or adjusted under 35 U.S.C. 154(b) by 185 days.

(21) Appl. No.: 14/340,203

(22) Filed: Jul. 24, 2014

Related U.S. Application Data

(63) Continuation-in-part of application No. 13/958,402, filed on Aug. 2, 2013, now Pat. No. 9,714,742.

(60) Provisional application No. 61/807,625, filed on Apr. 2, 2013, provisional application No. 61/778,316, filed on Mar. 12, 2013, provisional application No. 61/679,575, filed on Aug. 3, 2012.

(51) Int. Cl.
*F21K 2/06* (2006.01)
*F21V 33/00* (2006.01)

(52) U.S. Cl.
CPC ..... *F21K 2/06* (2013.01); *F21V 33/00* (2013.01)

(58) Field of Classification Search
CPC ..... F21K 2/06; B65D 1/04; F21V 33/10
USPC ..... 362/34
See application file for complete search history.

(56) References Cited

U.S. PATENT DOCUMENTS

| | | | |
|---|---|---|---|
| 1,568,550 | A | 1/1926 | Gottesman et al. |
| 3,385,545 | A | 5/1968 | Patton |
| 3,515,263 | A | 6/1970 | Carlson |
| 3,813,534 | A | 5/1974 | Gilliam |
| 4,871,099 | A | 10/1989 | Bogar, Jr. |
| 5,029,049 | A | 7/1991 | Ladyjensky |
| 5,067,051 | A | 11/1991 | Ladyjensky |
| 5,190,366 | A | 3/1993 | World |
| 5,344,670 | A | 9/1994 | Palmer |
| 5,430,622 | A | 7/1995 | Kuo et al. |
| 5,508,893 | A | 4/1996 | Nowak et al. |
| 5,599,551 | A | 2/1997 | Kelly |

(Continued)

FOREIGN PATENT DOCUMENTS

| | | |
|---|---|---|
| CN | 202140799 | 2/2012 |
| JP | 2173180 | 7/1990 |

(Continued)

OTHER PUBLICATIONS

Chapa, "Recycled tube light by Castor Canadensis", Sep. 26, 2007, http://inhabitat.com/recycled-tube-light-by-castor-canadensis/.

(Continued)

*Primary Examiner* — Karabi Guharay

(74) *Attorney, Agent, or Firm* — Peacock Law P. C.; Justin R. Jackson; Deborah A. Peacock

(57) ABSTRACT

A container for a substance combined with a glow stick. The substance is preferably disposed around or on top of the glow stick and the combination of substance and glow stick is disposed inside the container. In one embodiment the glow stick is disposed on or around the container for the substance. In a different embodiment the glow stick protrudes in part from or completely out of the container. In another embodiment the glow stick is disposed in the container and the combination of container and glow stick is surrounded with the substance.

11 Claims, 13 Drawing Sheets

(56) References Cited

U.S. PATENT DOCUMENTS

| | | | | |
|---|---|---|---|---|
| 5,671,998 | A | 9/1997 | Collet | |
| 5,705,103 | A | 1/1998 | Chopdekar et al. | |
| 5,715,952 | A | 2/1998 | Chichetti | |
| 5,871,106 | A | 2/1999 | Oksa et al. | |
| 5,938,313 | A | 8/1999 | Fujita | |
| 6,012,820 | A | 1/2000 | Weber et al. | |
| 6,062,380 | A * | 5/2000 | Dorney | A47G 19/2227 206/217 |
| 6,471,364 | B1 | 10/2002 | Plante | |
| 6,543,100 | B1 | 4/2003 | Finley et al. | |
| 6,572,244 | B1 | 6/2003 | Clark | |
| 6,685,331 | B1 | 2/2004 | Rockwell | |
| 6,776,495 | B2 | 8/2004 | Nomiyama | |
| 6,793,362 | B2 * | 9/2004 | Tai | A47G 19/2227 362/101 |
| 7,083,294 | B2 | 8/2006 | Steinberg | |
| 7,216,998 | B2 | 5/2007 | Fujita | |
| 7,234,827 | B2 | 6/2007 | Fujita | |
| 7,416,689 | B2 | 8/2008 | Yamate | |
| 7,422,339 | B2 * | 9/2008 | Jordan | A47G 19/2227 362/34 |
| 7,438,428 | B2 | 10/2008 | Schrimmer et al. | |
| 7,614,512 | B2 * | 11/2009 | Nader | B65D 1/04 206/217 |
| 7,682,033 | B2 | 3/2010 | Cranor | |
| 8,348,465 | B2 | 1/2013 | Schrimmer et al. | |
| 2002/0004942 | A1 * | 1/2002 | Bryan | A23G 3/366 800/288 |
| 2003/0137827 | A1 | 7/2003 | Bouton et al. | |
| 2005/0007760 | A1 | 1/2005 | Wu | |
| 2006/0098420 | A1 * | 5/2006 | Kaplan | F21K 2/06 362/34 |
| 2007/0047216 | A1 | 3/2007 | Plazzolla | |
| 2007/0090010 | A1 | 4/2007 | Crabtree et al. | |
| 2008/0057089 | A1 | 3/2008 | Molina | |
| 2008/0230504 | A1 * | 9/2008 | Nowzari | B65D 1/04 215/6 |
| 2008/0246009 | A1 | 10/2008 | Fujita et al. | |
| 2009/0185995 | A1 | 7/2009 | Vochecowicz et al. | |
| 2009/0207582 | A1 | 8/2009 | Dorsey et al. | |
| 2010/0014275 | A1 * | 1/2010 | Cranor | F21K 2/06 362/34 |
| 2010/0020529 | A1 | 1/2010 | Brooks et al. | |
| 2011/0114802 | A1 | 5/2011 | Hjerpe | |
| 2011/0284583 | A1 | 11/2011 | Fazzolari | |
| 2012/0056131 | A1 | 3/2012 | Nagel | |
| 2012/0097063 | A1 | 4/2012 | Cranor et al. | |
| 2012/0230009 | A1 | 9/2012 | Friedson | |
| 2012/0275142 | A1 | 11/2012 | Lundy | |
| 2013/0001485 | A1 | 1/2013 | Li et al. | |
| 2013/0248470 | A1 | 9/2013 | Klein | |

FOREIGN PATENT DOCUMENTS

| | | |
|---|---|---|
| JP | 2011137134 | 7/2011 |
| WO | 2007052092 | 5/2007 |
| WO | 2008007381 | 1/2008 |

OTHER PUBLICATIONS

Cosmic Bear Glow in the Dark Lubricant, http://naturelabsbrands.com/personal-lubricant/nature-lovin/cosmic-bear, Apr. 29, 2013.

* cited by examiner

ILLUMINATED CONTAINER

CROSS-REFERENCE TO RELATED APPLICATIONS

This application is a continuation-in-part application of U.S. patent application Ser. No. 13/958,402, entitled "GLOW STICK CARRIER", to Kevin R. Jackson, filed on Aug. 2, 2013, which claims priority to U.S. Provisional Patent Application Ser. No. 61/679,575, entitled "GLOW STICK", filed on Aug. 3, 2012; U.S. Provisional Patent Application Ser. No. 61/778,316, entitled "GLOW STICK", filed on Mar. 12, 2013; and U.S. Provisional Patent Application Ser. No. 61/807,625, entitled "GLOW STICK CARRIER", filed on Apr. 2, 2013; and the entire specifications and claims thereof are incorporated herein by reference.

BACKGROUND OF THE INVENTION

Field of the Invention (Technical Field)

The present invention relates to containers, and more particularly to containers and/or carriers for products such as, but not limited to, candy (hard, liquid, powder), liquor, paint, antibiotics, hand sanitizer, intimate lubricant ("lube"), cigarettes, cosmetics, other objects, etc., that are marketable along a glow stick.

Description of Related Art

Glow sticks are plastic cylinders that contain two liquids that temporarily create light when they are mixed together. The cylinders typically are about 4 to 5 inches long and less than 1 inch in diameter. Glow sticks are available in many colors and are often used for decoration or entertainment, such as at parties, concerts and other nighttime events. They also have some practical uses for camping, military or police operations, underwater activities, or certain emergency situations. Thin, long glow sticks that are made of a more flexible plastic can take the form of necklaces, bracelets or other shapes. No matter what form they take, glow sticks depend on a chemical process known as chemiluminescence to produce their light. In chemiluminescence, a chemical reaction causes a release of energy. Electrons in the chemicals become excited and rise to a higher energy level. When the electrons drop back to their normal levels, they produce energy in the form of light. The chemicals used to create this reaction in glow sticks are usually hydrogen peroxide and a mixture of phenyl oxalate ester and the fluorescent dye. A different way to create a glow stick can be the integration of a light-emitting diode ("LED") with a container for a solid, liquid, gas, or combinations thereof.

Embodiments of the present invention improve the marketability of commercially-available glow sticks by combining or integrating them with containers and/or carriers for other products that, depending on the occasion and use for the glow stick, can increase sales or promote a substance. Embodiments of the present invention also relate to methods of advertising utilizing glow sticks combined with or integrated with containers and/or carriers of one or more substances.

BRIEF SUMMARY OF THE INVENTION

Further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

Embodiments of the present invention comprise an openable container comprising a glow stick and a substance disposed on the glow stick. In one embodiment, the substance is disposed around the glow stick. In one embodiment, the glow stick protrudes outside of the container. In one embodiment, the glow stick and the substance are isolated from each other through a third substance. The third substance can be, for example, the same material from which the container is made. Optionally, the third substance is at least partially transparent. In another embodiment, the container comprises promotional material.

In a different embodiment, the container comprises a second container for storage of the combination of the substance and the glow stick. Optionally, the glow stick protrudes from the second container.

In another embodiment, an openable container comprises a glow stick and a substance that is preferably disposed around container. Preferably, the substance is at least partially translucent. Optionally, the substance comprises perforations to let the light of the glow stick shine through when the glow stick is activated.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

As used throughout this application and claims, the term "phosphors" means substances that radiate visible light when they are energized, for example, calcium sulfide with strontium sulfide with bismuth as an activator to yield blue light or strontium sulfide to obtain red light.

As used throughout this application and claims, the term "container" mans any object used for or capable of holding a substance, for example, for transport or storage fabricated of transparent or opaque materials.

As used throughout this application and claims, the term "substance" can include any solid, liquid, gas, or combination thereof. In one embodiment, the term substance can optionally include but is not limited to a substance which can be for an opportune use—for example, candy for a child's party, or liquor or lube for adults at a night club.

As used throughout this application and claims, the term carrier means one or more containers for carrying any substance or object, whether solid, liquid, gaseous, combinations thereof, and the like.

As used throughout this application and claims, the term "glow stick" refers to a self-contained, short-term light-source, preferably made from a translucent plastic tube comprising isolated substances that, when combined, make light through chemiluminescence, or light sources that can substitute these sources, e.g., a light-emitting diode ("LED") integrated with a container for a solid, liquid, gas, or combinations thereof.

As used throughout this application and claims, the term "attachment" means any means of attaching, disposing, coupling, or affixing a container to a glow stick, including but not limited to, gluing, snapping, hanging, taping, stapling, tying, etc.

In one embodiment, a glow stick is used in combination with a container that is disposed on top of or surrounding the glow stick. Preferably, a substance is disposed in the container. In one embodiment the substance is disposed around or on top of the glow stick and the combination of substance and glow stick is disposed inside the container. In another embodiment the glow stick is disposed on or around the substance and the combination of substance and glow stick is disposed in the container. In a different embodiment the glow stick protrudes in part from or completely out of the container. In a further embodiment, one or more LEDs can be used in lieu of chemo luminescence.

Figure 1:
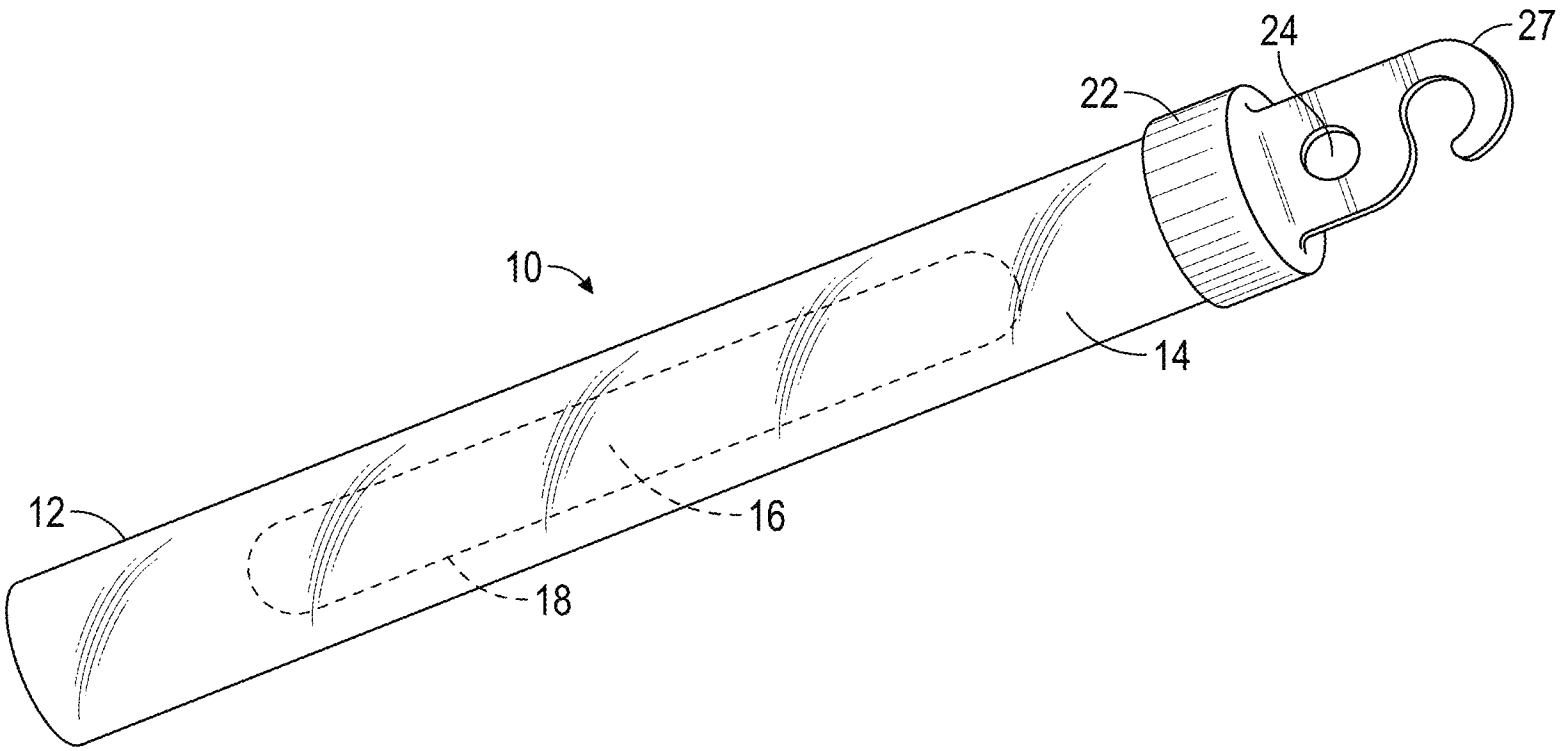
FIG. 1 is a perspective view schematic of an off-the-shelf glow stick.

Referring to FIG. 1, a common glow stick is shown generally comprising cylindrical housing 10, comprising chemo-luminescent reagent holding area 12, which is filled with first reagent 14. Second reagent 16 is contained in fragile ampoule 18, which resides also in chemo luminescent reagent holding area 12. Rupture of fragile ampoule 18 through some sort of manipulation, e.g., bending cylindrical housing 10, causes the two reagents to mix and produce chemiluminescence. Some commercially available glow sticks are manufactured as a single piece injection-molded-body. Some commercially available glow sticks comprise a projection at one end providing coupling means, e.g., a hook, to hang the glow stick from a lanyard or the like. However, many glow sticks comprise a cap 22 at one end, wherein cap 22 comprises said projections. In FIG. 1, cap 22 comprises a projection defining eye 24, and hook 27 for hanging.

Figure 2:
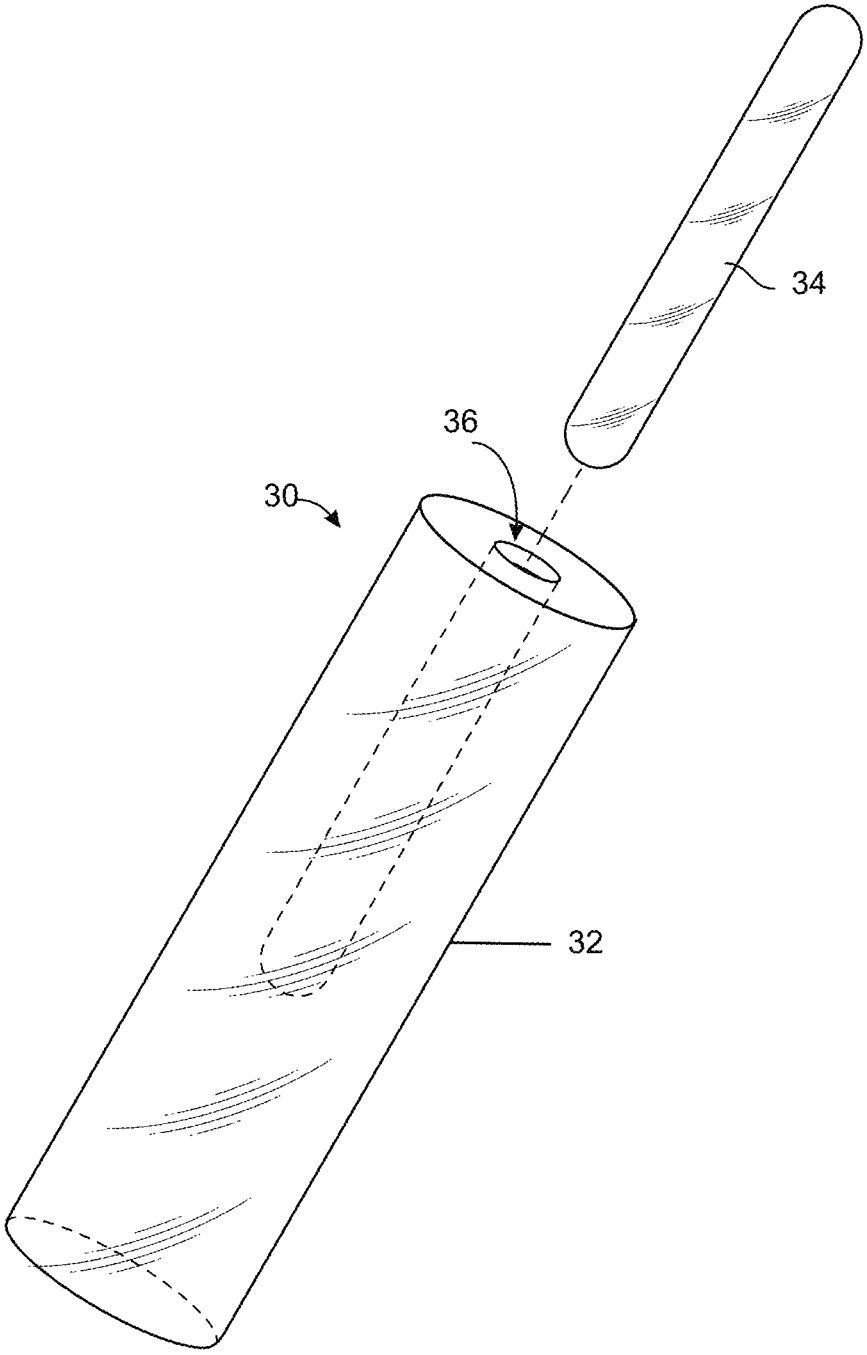
FIG. 2 is a perspective view of one embodiment of the present invention comprising holding space one or more substances and a cavity for accommodating an off-the-shelf glow stick.
Figure 3:
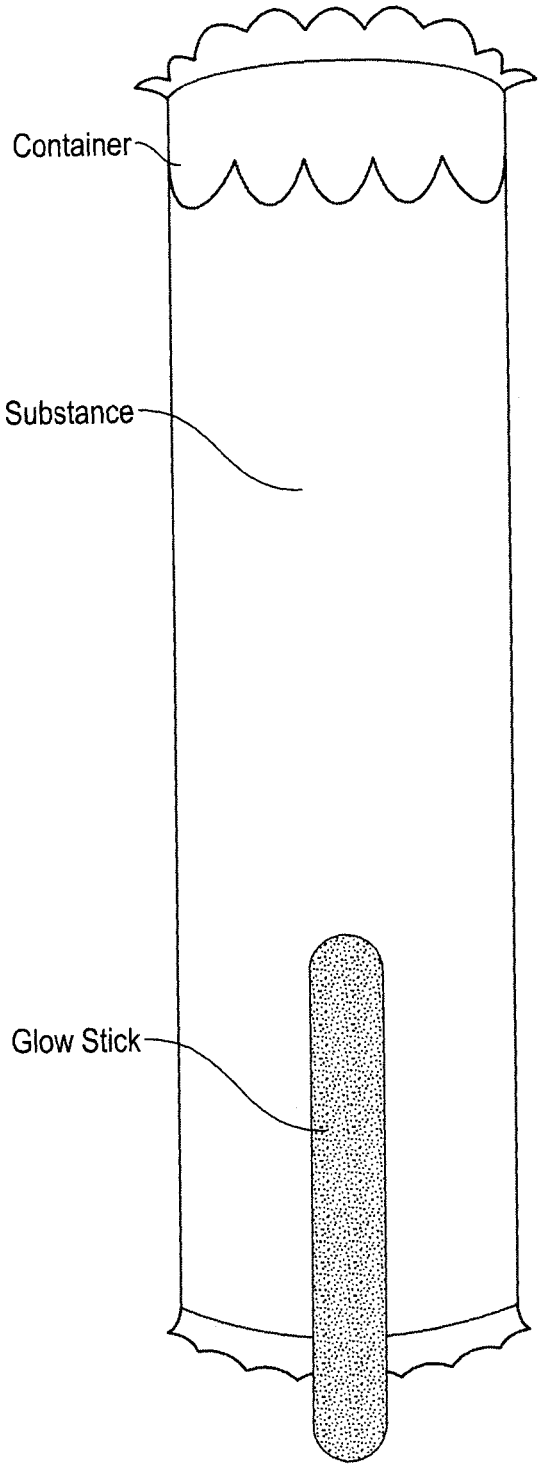
FIG. 3 shows the embodiment of FIG. 2 wherein the glow stick is protruding from the cavity.
Figure 4:
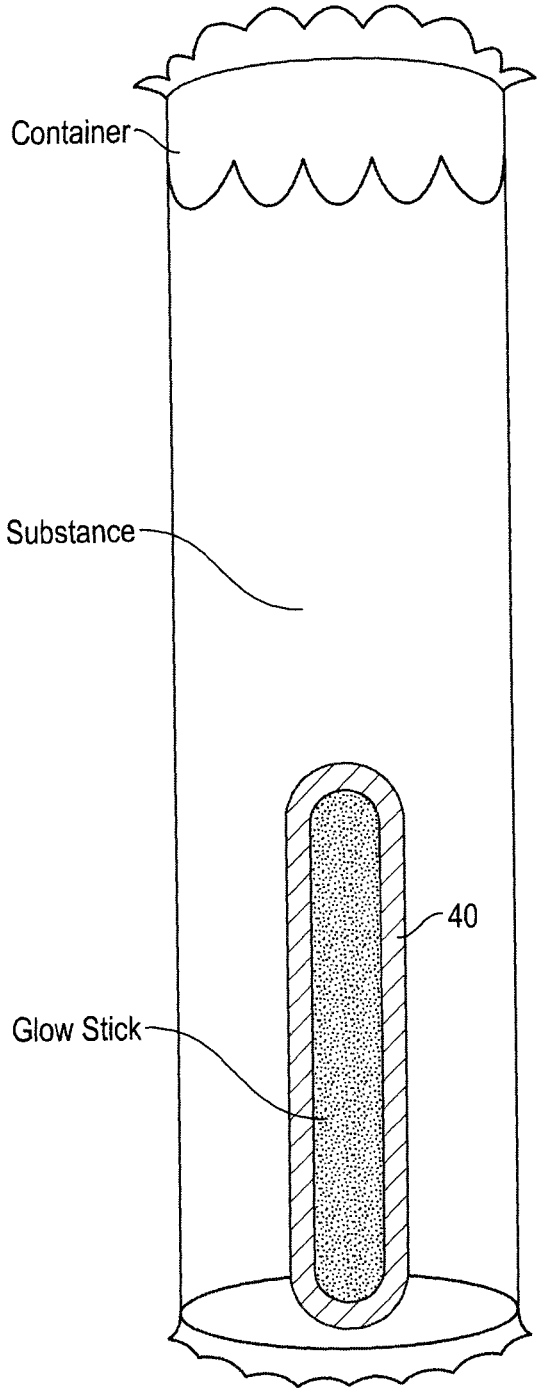
FIG. 4 shows a different embodiment of the invention comprising a container with holding space for one or more substances and a reinforced glow stick.
Figure 5:
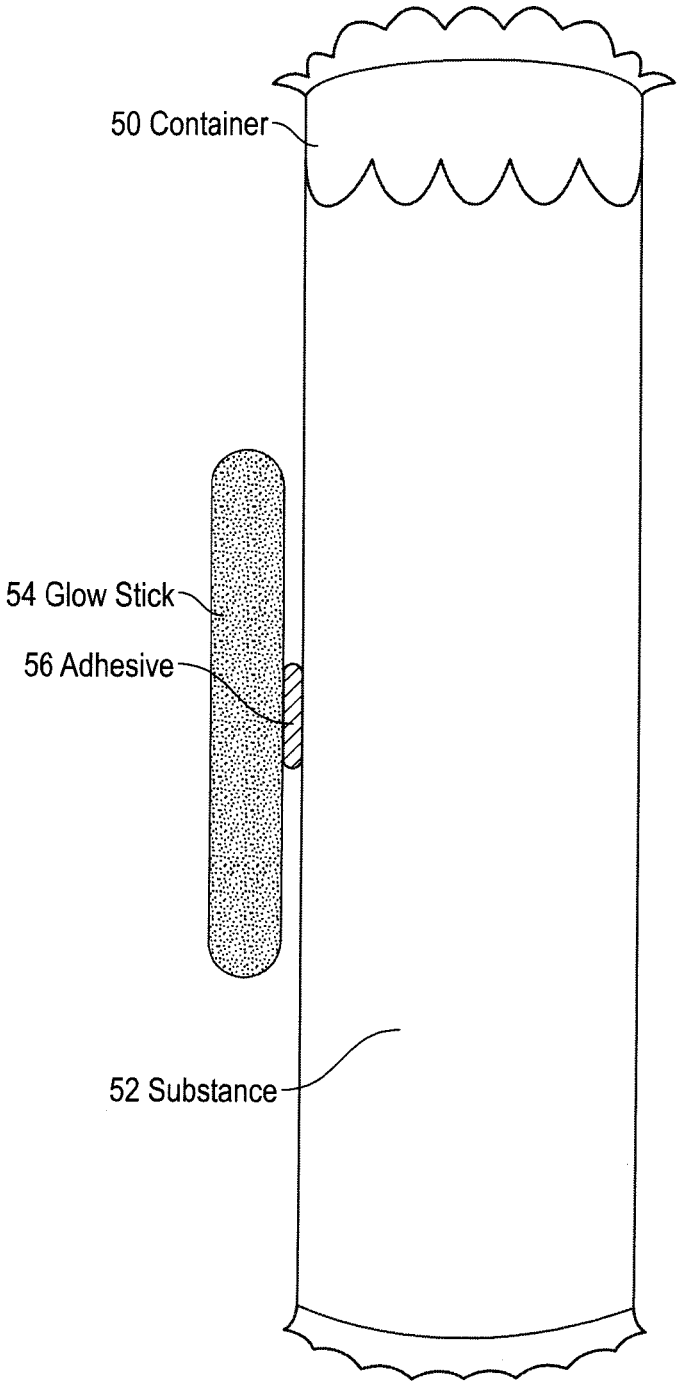
FIG. 5 shows a different embodiment of the invention comprising a container for one or more substances associated with a glow stick.

Referring to FIG. 2, one embodiment of the present invention comprises ice pop treat 30 comprising holding container 32, preferably for storage of a liquid such as sugary water, and cavity 36 that preferably accommodates glow stick 34. As shown if FIG. 3, in one embodiment, the glow stick optionally protrudes partially from holding container. In a different embodiment, the glow stick which is encapsulated in isolating, leak-proof surrounding membrane 40 is disposed directly into the substance contained in the holding container. See FIG. 4. Alternatively, when the material from which the glow stick was fabricated is leak-proof, such glow stick is disposed directly into the substance without a surrounding membrane. In yet another embodiment, container 50 for substance 52 comprises glow stick 54, which is attached, for example, with adhesive 56. See FIG. 5.

Figure 6:
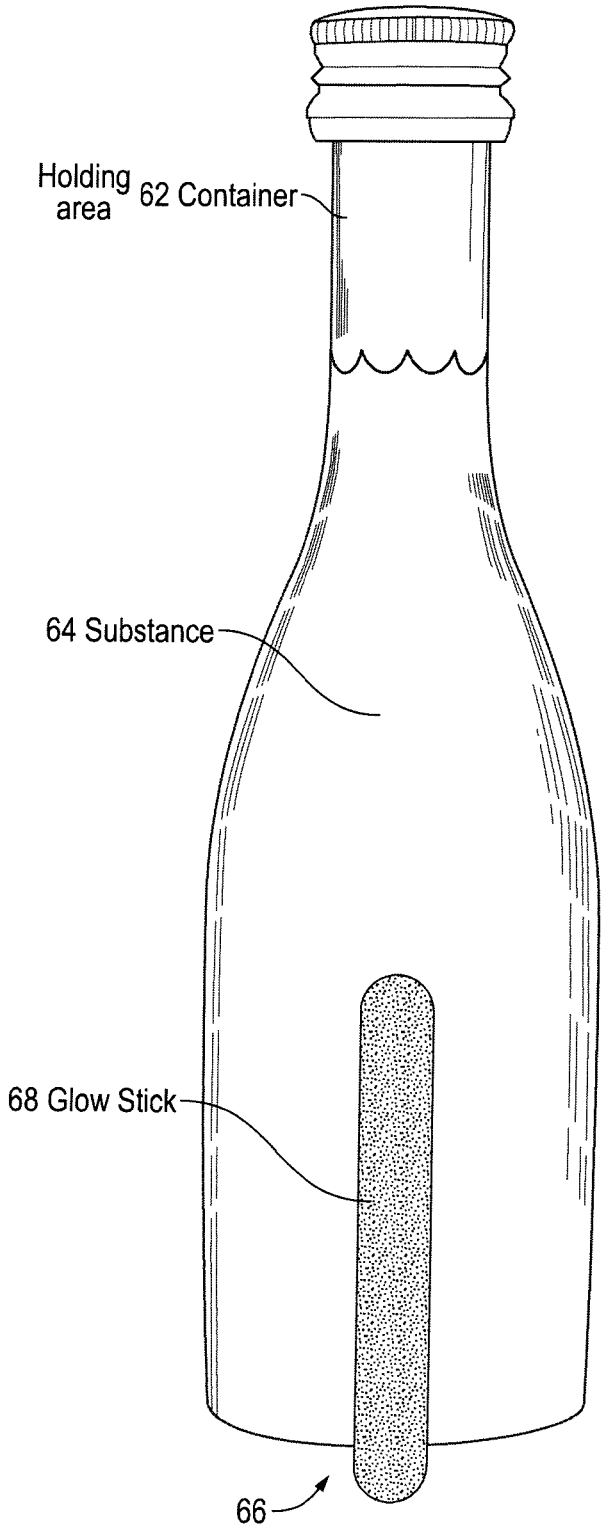
FIG. 6 shows a different embodiment of the present invention comprising a different kind of openable container comprising holding space for one or more substances and a cavity for accommodating a glow stick.

Referring to FIG. 6, in a similar embodiment of the invention, glow bottle 60, fabricated of a suitable material such as glass, plastic, etc., comprises holding area 62 for substance 64, for example, water, and cavity 66 for housing glow stick 68. In a different embodiment, the glow stick is encapsulated in an isolating, leak-proof surrounding membrane and is disposed directly into the substance contained in the container. Alternatively, when the material from which the glow stick was fabricated is leak-proof, such glow stick is disposed directly into the substance without a surrounding membrane. In yet another embodiment, the bottle comprises a glow stick, which is attached, for example, with an adhesive.

Figure 7:
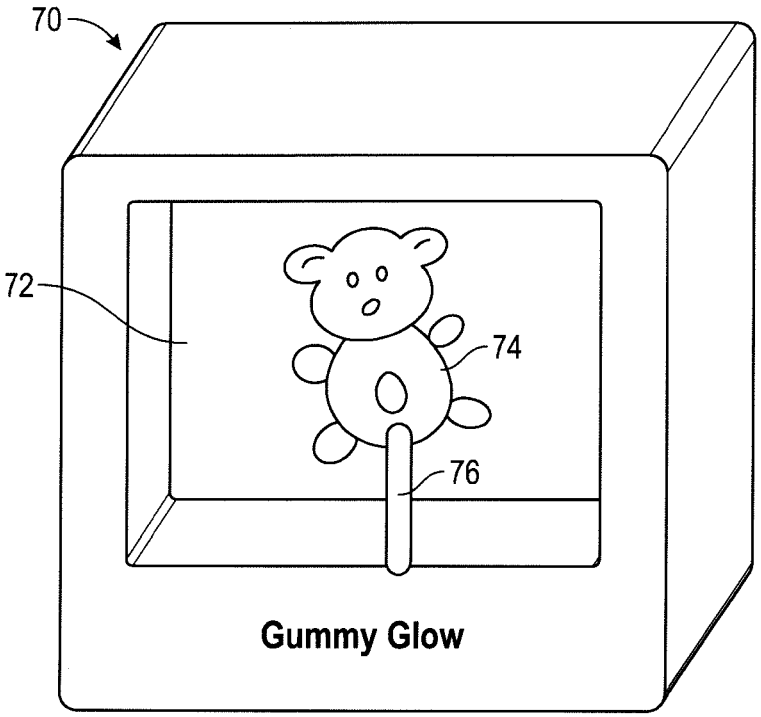
FIG. 7 shows a different embodiment of the present invention comprising a container with holding space for the combination of a substance with a glow stick.
Figure 8A:
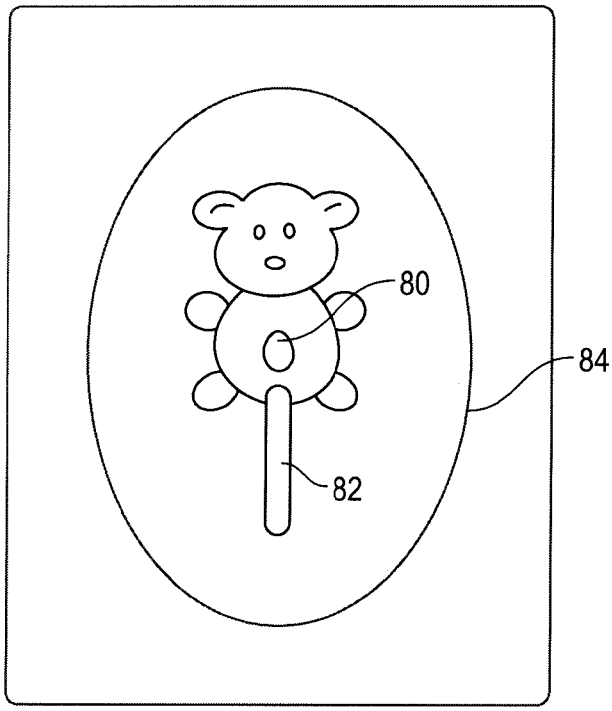
FIG. 8A shows an embodiment of the present invention comprising a container with holding space for a second container comprising the combination of a glow stick and a substance.
Figure 8B:
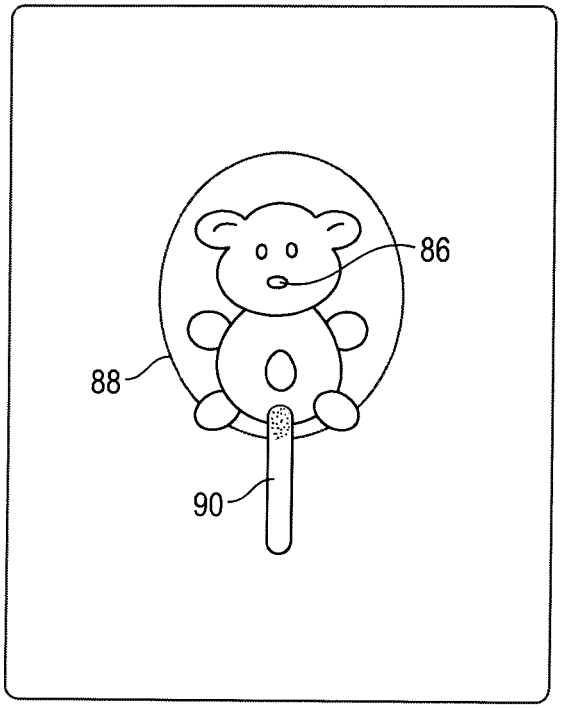
FIG. 8B shows an embodiment of the present invention comprising a container with holding space for a second container comprising the substance where the glow stick is protruding from the contained substance.

Referring to FIG. 7, in another embodiment of the present invention, container 70 comprises holding area 72 for substance 74, for example, candy, and glow stick 76. In one embodiment, substance 74 is disposed on, or around glow stick 76. Optionally, substance 74 is at least partially translucent to transmit some of the light emitted by glow stick 74 when it is activated. Because the material from which container 70 is fabricated is encasing the combination of substance 74 and glow stick 76, the risk of product damage is reduced. Referring to FIG. 8A, in one embodiment, a container comprises the combination of substance 80 and glow stick 82 is disposed in secondary container 84, for example a plastic wrap. Alternatively, secondary container 88 is disposed only on substance 86 and glow stick 90 protrudes partially or completely from the combination of container 88 and substance 86. See FIG. 8B.

Figure 9:
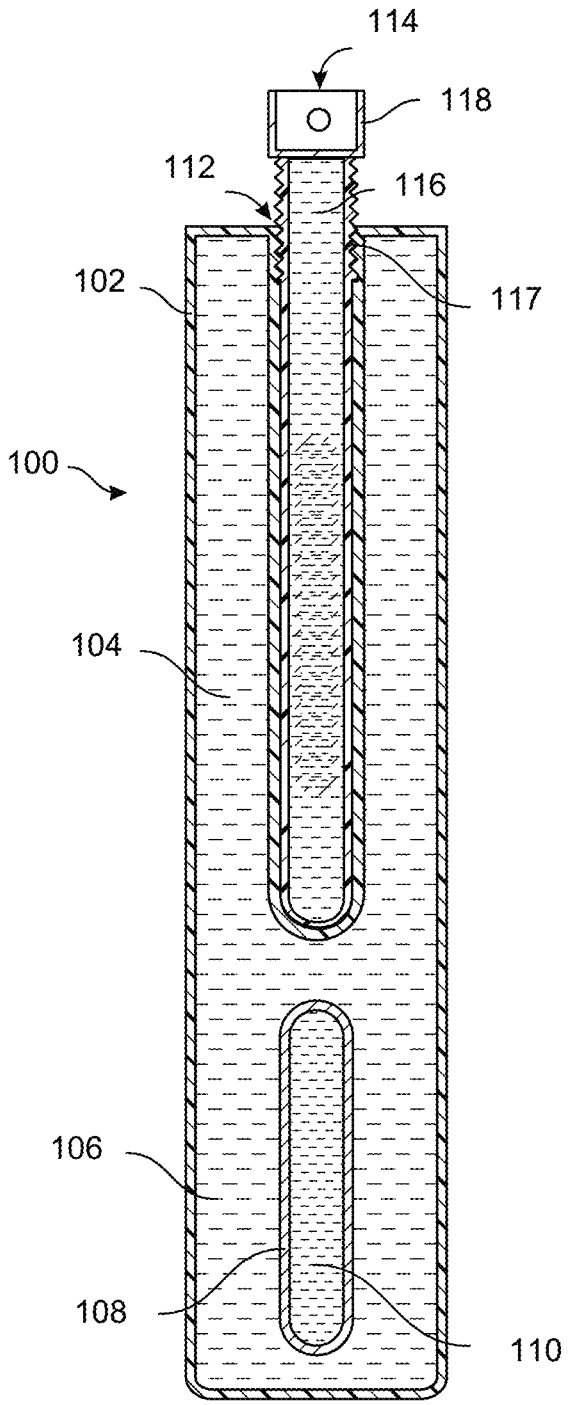
FIG. 9 shows a cross-sectional view of a different embodiment of the invention where a glow stick comprises a cavity to accommodate a spray container for a substance.

Referring to FIG. 9, according to one embodiment of the present invention, glow stick 100 comprises casing 102, made for example of plastic commodity resins such as PVC, PE, PS, Nylon, Rubber, Silicon, or Vinyl (but not limited thereto). Casing 102 comprises, chemo-luminescent reagent holding area 104, which comprises first solution 106, for example, phenyl oxalate and florescent die, and breakable ampoule 108 inside of it. Breakable ampoule 108 is filled with second solution 110, for example, a hydrogen peroxide solution, for chemiluminescence. When breakable ampoule 108 is broken through some type of manipulation, e.g., squeezing or bending casing 102, second solution 110 is released and mixes with first solution 106, reacting to produce chemiluminescence. Glow stick 100 also preferably comprises cavity 112 which can be, in one embodiment, cylindrical in shape. Cavity 112 can accommodate spray container 114 of a shape that fits in it for a substance 116, such as, but not limited to, liquor, paint, candy, antibiotic ointment, hand sanitizer, intimate lubricant ("lube"), etc. Spray container 114 preferably comprises spray nozzle 118. Preferably, a mechanism for spray container 114 to remain attached to cavity 112 is provided, such as, but not limited to threading 117.

Figure 10:
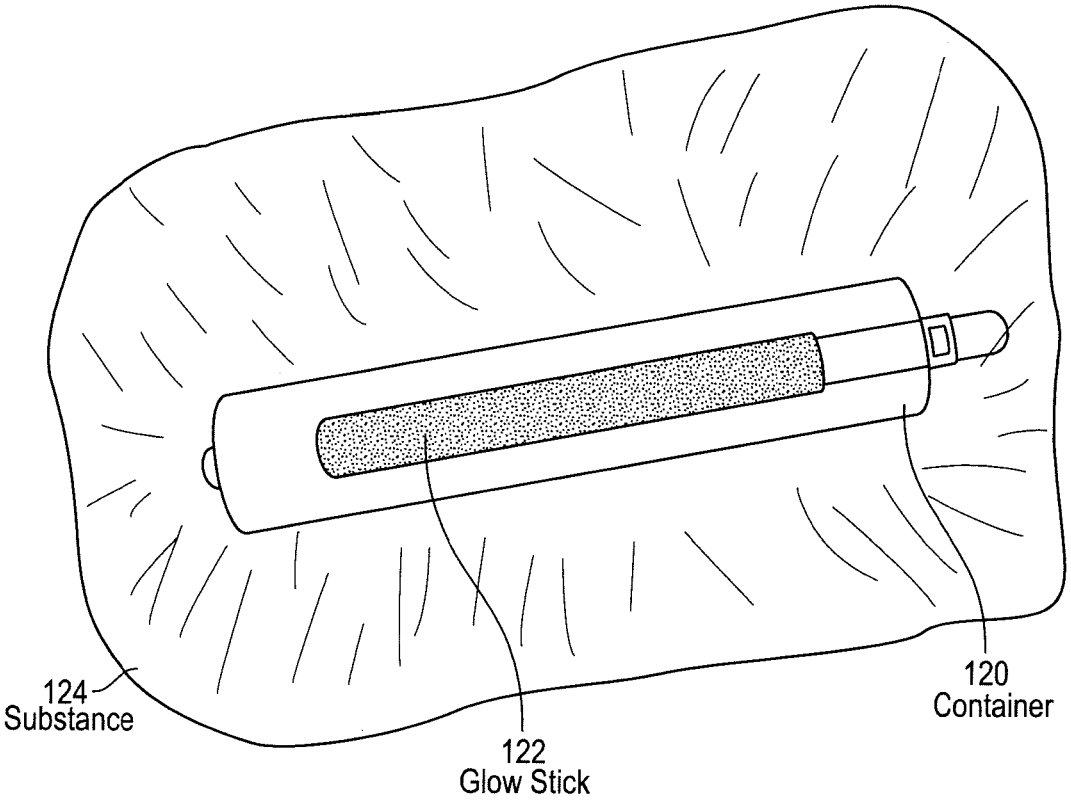
FIG. 10 shows a different embodiment of the invention where a container holds a glow stick and is surrounded by a substance.

Referring to FIG. 10, in a different embodiment of the invention, container 120 houses glow stick 122 while substance 124 is disposed on or around container 120. In one embodiment, glow stick 122 protrudes from container 120 into substance 124. In a different embodiment, glow stick 122 protrudes from substance 124 as well as container 120. Preferably, substance 124 is at least partially translucent or has perforations or other means to allow at least some of the light emitted by glow stick 122 when it is activated.

In another embodiment of the invention, promotional material, such as ads, is placed on a container comprising a substance and a glow stick.

INDUSTRIAL APPLICABILITY

The invention is further illustrated by the following non-limiting examples.

Example 1

Figure 11B:
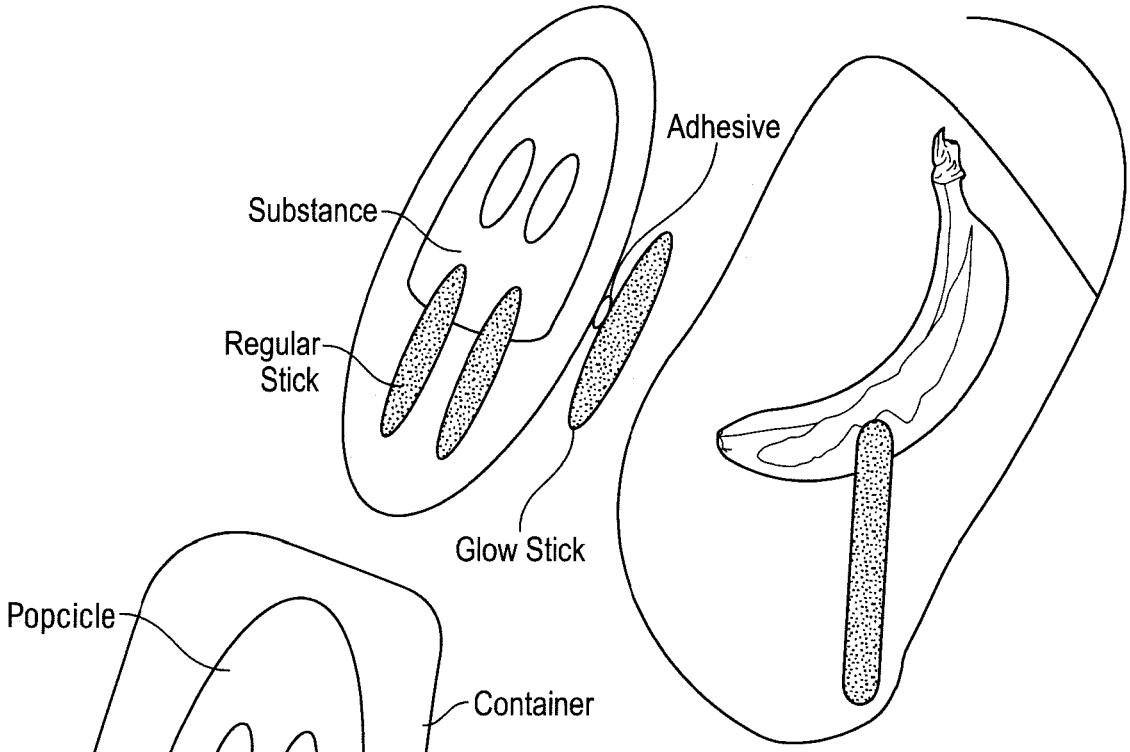
FIG. 11B shows a banana treat with a glow stick for holding wrapped in a container.
Figure 11A:
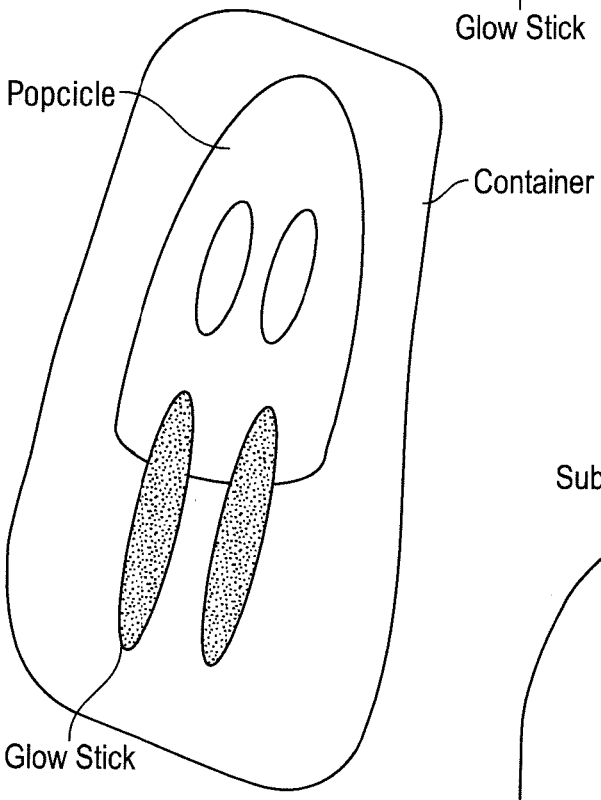
FIG. 11A shows an ice pop with glow sticks for holing sticks wrapped in a container.

A double ice pop was manufactured with glow sticks substituting the wooden sticks typically used for this product. The combination was disposed in a cellophane wrapping container and then sealed. See FIG. 11A.

Example 2

A frozen banana treat was made wherein a glow stick was disposed in a banana and then frozen. The banana and glow stick combination was disposed into a cellophane wrapping container and then sealed. See FIG. 11B

Example 3

Figure 11C:
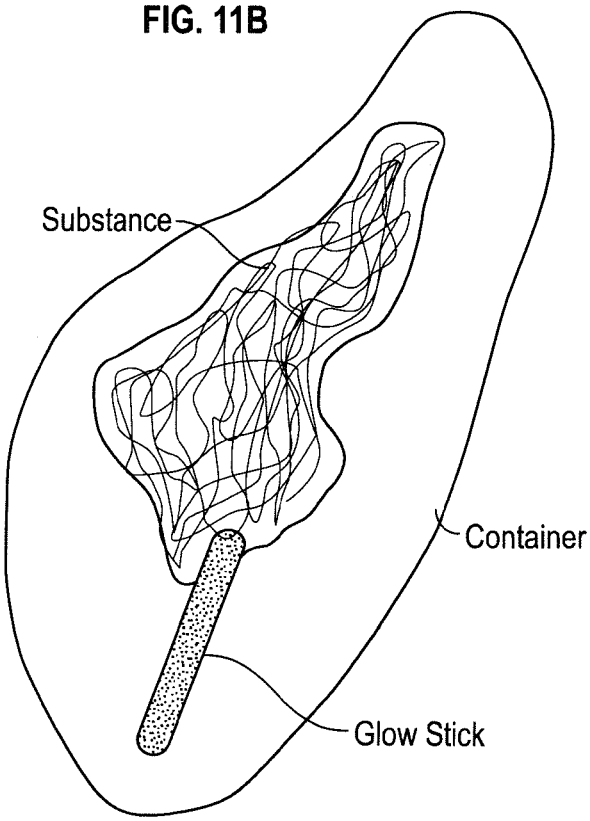
FIG. 11C shows a cotton candy treat with a glow stick for holding wrapped in a container.

A glow cotton candy treat was made by placing cotton candy on a glow stick. The combination of glow stick and cotton candy was disposed into a plastic bag and then sealed. See FIG. 11C.

Example 4

A glow paper towel roll apparatus was manufactured by providing a clear paper towel roll holder with a glow stick inside of it. When a roll of paper towels was disposed on the clear holder, the light of the activated glow stick shone from the roll's tube openings.

Example 5

Figure 12:
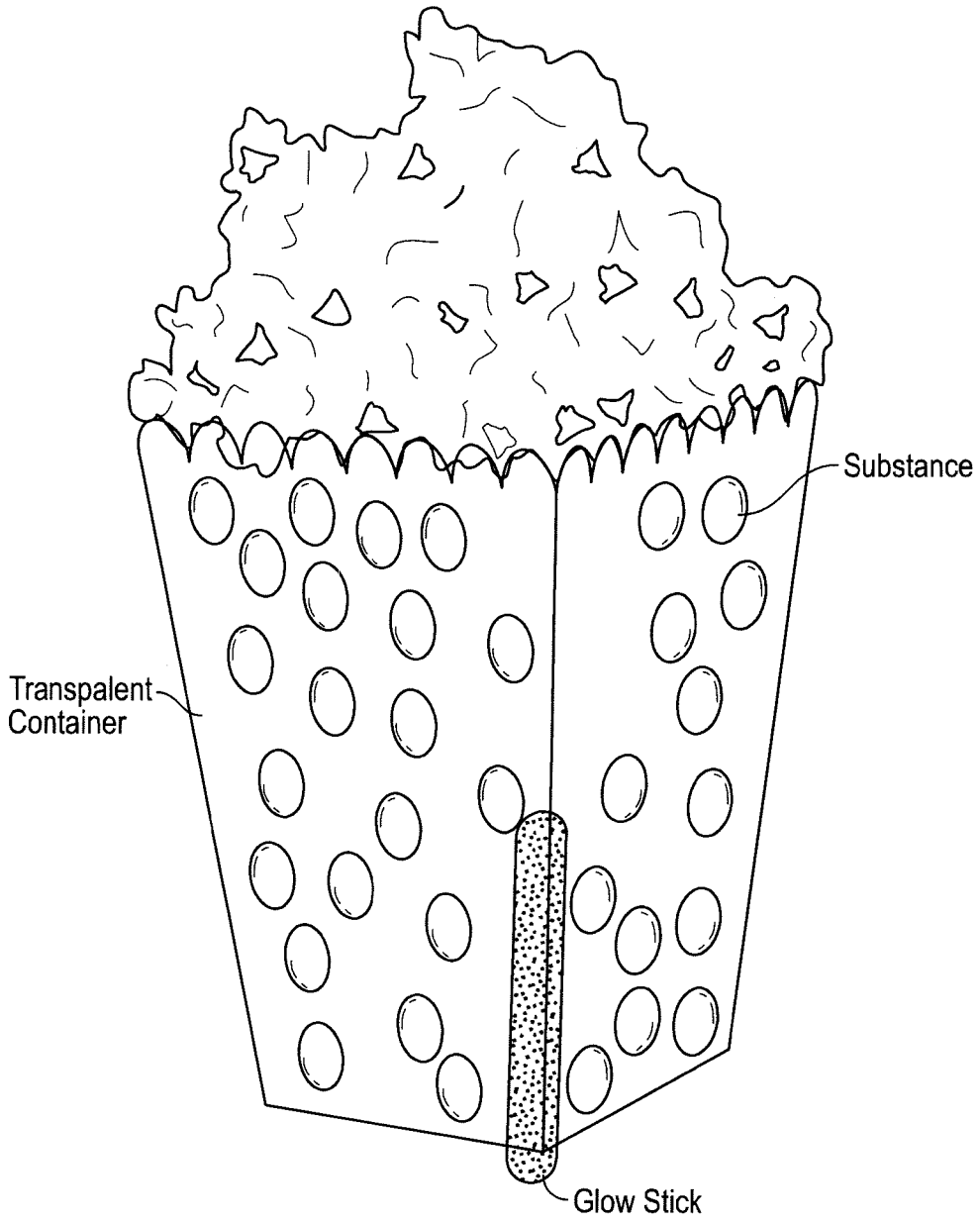
FIG. 12 shows a container of popcorn with a glow stick.

A glowing popcorn apparatus was made by providing a clear bag container of popcorn with a glow stick. When the glow stick was activated, its light shone through the popcorn in the clear bag. See FIG. 12.

Example 6

Figure 13:
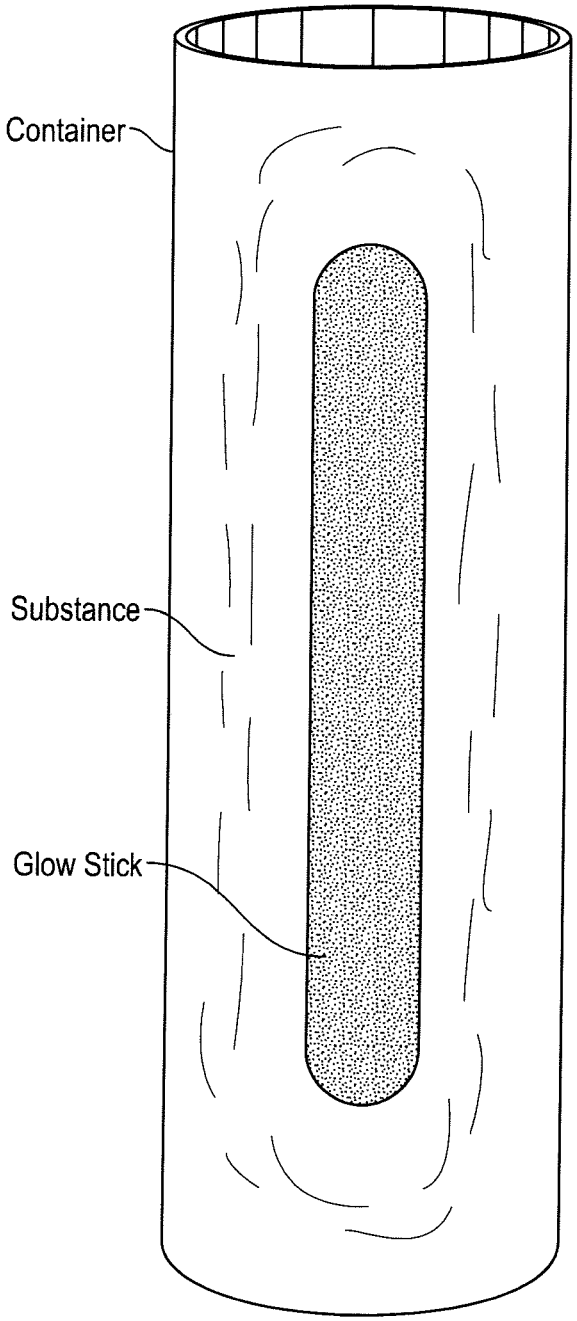
FIG. 13 shows a test tube container with a glow stick disposed inside and surrounded by candy.

A glowing candy clear test tube was made by disposing a glow stick in a clear plastic test tube. The test tube was filled with soft clear gummy candy and closed. When the glow stick was activated, its light shone through the candy. See FIG. 13.

The preceding examples can be repeated with similar success by substituting the generically or specifically described components and/or parameters of this invention for those used in the preceding examples.

Note that in the specification and claims, "about" or "approximately" means within twenty percent (20%) of the numerical amount cited.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. An illuminated spray container comprising:
- a casing container;
- said casing container comprising an opening configured to receive a spray container;
  - an integrated light source comprising all components necessary for illumination, disposed within said casing container and not on a side of said casing container;
  - said spray container positionable within said opening of said casing container such that contents of said spray container do not mix with contents of said casing container;
  - a spray nozzle;
  - said spray nozzle disposed on said spray container;
  - an attachment mechanism disposed within said opening of said casing container; and
  - said attachment mechanism configured to attach said spray container within said opening of said casing container.

2. The illuminated container of claim 1 wherein said spray container is filled with a consumable liquor.

3. The illuminated container of claim 1 wherein said attachment mechanism comprises threads.

4. The illuminated container of claim 1 wherein said spray container is filled with intimate lubricant.

5. The illuminated container of claim 1 wherein said spray container is filled with candy.

6. The illuminated container of claim 1 wherein said spray container is filled with hand sanitizer.

7. The illuminated container of claim 1 wherein said integrated light source comprises a chemiluminescent light source.

8. The illuminated container of claim 1 wherein a first chemiluminescent reagent is disposed in said casing container.

9. The illuminated container of claim 8 further comprising a breakable ampoule disposed within said casing container.

10. The illuminated container of claim 9 wherein said breakable ampoule comprises a second chemiluminescent reagent disposed therein.

11. The illuminated container of claim 8 further comprising a fluorescent dye disposed in said casing container.

* * * * *